United States Patent [19]

Engelhardt et al.

[11] 4,183,436

[45] Jan. 15, 1980

[54] STOCK OR SHIPPING CONTAINER

[75] Inventors: Bernard Engelhardt; Dennis E. McKay, both of Toronto, Canada

[73] Assignee: Bernard Engelhardt, Toronto, Canada

[21] Appl. No.: 887,807

[22] Filed: Mar. 17, 1978

[51] Int. Cl.[2] ..... B65D 5/54; B65D 17/06; B65D 17/24

[52] U.S. Cl. ..... 206/622; 229/33; 229/44 R; 229/47; 229/87 S

[58] Field of Search ..... 229/33, 36, 87 S, 44 R, 229/47, 78 A, 37 R; 206/622, 282, 278, 626

[56] References Cited

U.S. PATENT DOCUMENTS

| | | | |
|---|---|---|---|
| 1,182,174 | 5/1916 | Hogan | 229/78 A |
| 2,757,850 | 8/1956 | Kleiber | 206/622 |
| 2,864,547 | 12/1958 | Guyer | 206/622 |
| 2,868,431 | 1/1959 | Painter | 229/44 R |
| 2,894,674 | 7/1959 | Wagaman | 206/622 |
| 3,059,827 | 10/1962 | Pellaton et al. | 206/626 |
| 3,136,471 | 6/1964 | Brastad | 206/622 |
| 3,352,692 | 11/1967 | Wysocki | 206/628 |
| 3,436,893 | 4/1969 | Vokes et al. | 229/44 R |

*Primary Examiner*—Stephen P. Garbe
*Attorney, Agent, or Firm*—Alan Swabey; Robert Mitchell; Guy J. Houle

[57] ABSTRACT

A box-type rectangular container of sheet material having nesting tray and cover parts having a floor and roof respectively and overlapping sidewalls. A pair of the overlapping walls is cut and creased to provide inside and outside access panels for swinging outwards to reach the contents without opening the container. Optionally, catch means may be provided for retaining the access panels reclosed after they have been opened.

10 Claims, 7 Drawing Figures

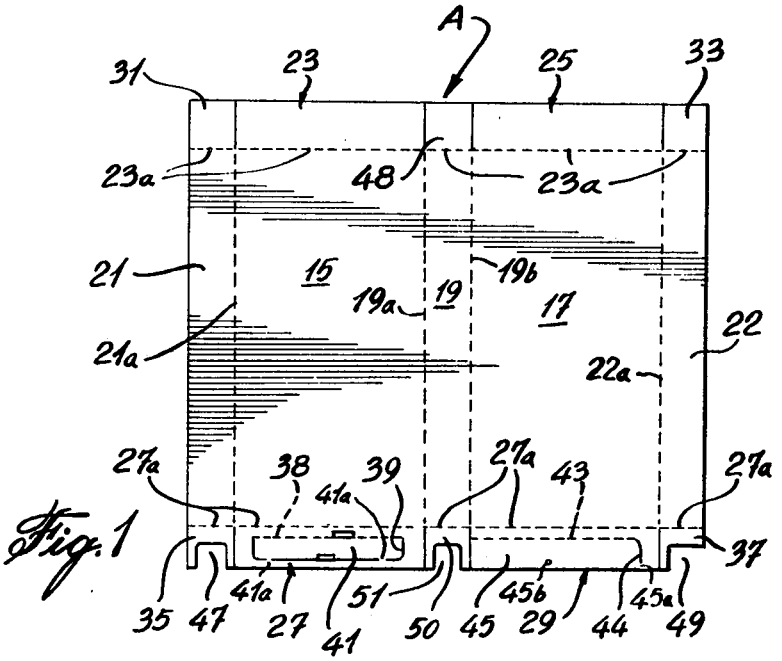
Fig. 1
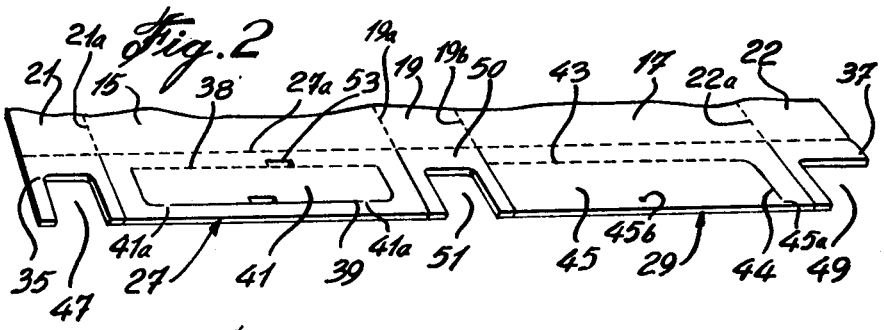
Fig. 2
Fig. 3
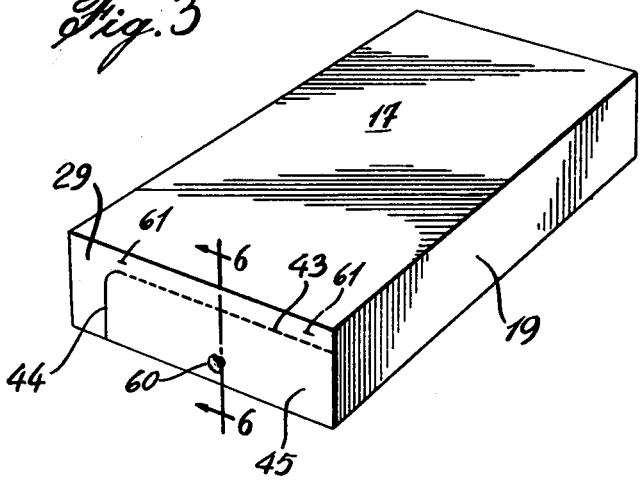

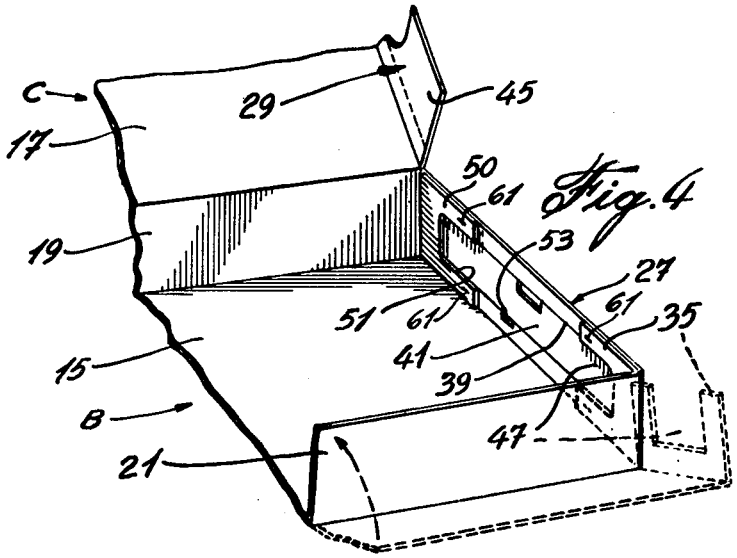
Fig. 4
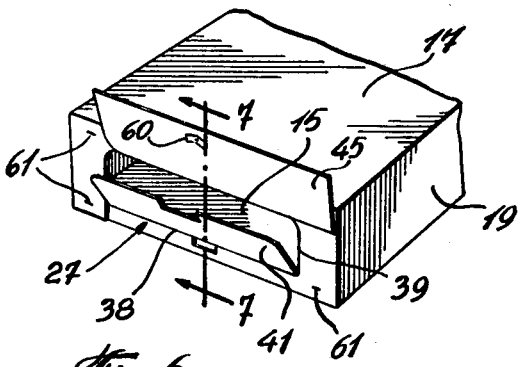
Fig. 5
Fig. 6
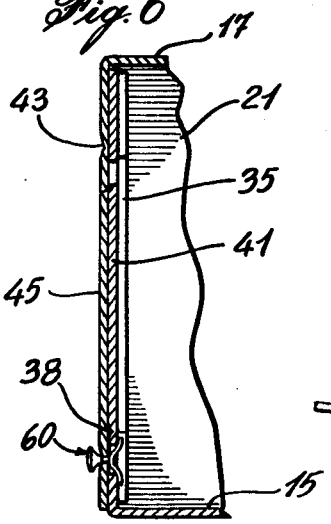
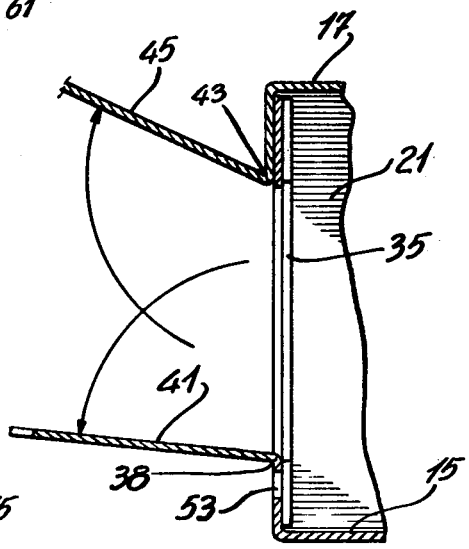
Fig. 7

STOCK OR SHIPPING CONTAINER

BACKGROUND OF THE INVENTION

1. Field of the Invention

This invention relates to a reclosable stock or shipping container.

2. Description of the Prior Art

One standard form of container to which the invention may be applied is known as a "clothing wrapper" and is made from a one-piece blank of corrugated paperboard, by cutting, creasing and folding. In setting it up from the blank, a tray part having a floor and walls is formed along with a cover part hinged to the top of one of the walls and having a roof and three walls adapted to overlap walls of the tray part when the container is closed.

Another type of container to which the invention applies is made up of separate tray and cover parts which nest one within the other. The tray part has a floor and four walls. The cover part has a roof and four walls, adapted to overlap the walls of the tray part.

In a container of either of these types, the contents are placed in the tray part and the cover part closed over it with the sides overlapping and connected ready for shipping.

Sometimes after the container is closed, it is desirable to remove some of the contents without disturbing others and, with the containers described, this cannot normally be done without completely opening them.

SUMMARY OF THE INVENTION

The present invention provides containers of the types described of foldable sheet material in which access means is provided in the wall of the container which, when the container is closed and filled with merchandise, can be opened to remove contents, and closed again to protect them. This access means may take the form of inside and outside access panels formed by appropriate cutting and creasing in overlapping end-forming flaps, the panels being adapted for hinging outwards to provide an access passage. Preferably, a removable catch member is provided which can be inserted in an opening provided in the outer panel to engage in an opening provided on the inner flap for securing the access panels in closed position when the container is to be used as a stock box.

More specifically, one preformed form of the invention contemplates a blank of foldable sheet material for forming the container, cut and creased to provide elongated panels each connected to its adjacent panel by a crease. The panels include in series a first side-forming panel, optionally having a corner flap at each end, a floor panel having a wall-forming flap at each end, a side panel, optionally having a corner flap at each end, a roof panel having a wall-forming flap at each end, and a second side-forming panel, optionally having a corner flap at each end. At one end of the blank, the end-forming flap of the floor panel is provided with a crease parallel to its connection to the floor panel and a circuitous cut extending from the crease defining an inner access flap hingeable about the crease. The corresponding end-forming flap of the roof panel is provided with a crease parallel to its connection with the roof panel which extends from its edge closest to the floor panel to a point spaced from the opposite edge and a cut which extends from its outer edge to the crease to provide an outer access panel which hinges about the crease. Each of the corresponding corner flaps, where present, has an opening for clearing the access flaps when the container is assembled. Desirably, the outer access panel is provided centrally with a hole to receive a catch member and the inside flap with an opening through which the catch member protrudes to engage the flap.

More specifically, a container, according to the invention, has a tray part made up of a floor panel and upstanding therefrom walls in the form of opposed side-forming panels and end-forming panels connected to the side-forming panels at the corners. The container has a related cover part including a roof panel and walls in the form of at least one side-forming panel which overlap the side and end-forming panels of the tray part when the container is closed and endforming panels connected at the corners to the side-forming panel. The access structure as described above is provided in the respective overlapping end-forming panels of the tray and cover.

Application of the invention to the type of container in which the cover part and tray part are separate is similar. In this case, however, instead of the roof of the cover part being joined to a side which is common to both the tray and cover parts, it is joined to its own fourth side. With the tray part nested within the cover part, when the container is closed, however, the overlapping end walls are in the same position relative to each other as with the clothing wrapper type container.

BRIEF DESCRIPTION OF THE DRAWINGS

Having generally described the invention it will be referred to in more detail by reference to the accompanying drawings illustrating a preferred embodiment, and in which:

FIG. 1 is a plan view showing a blank suitable for making a reclosable stock or shipping container, according to the invention;

FIG. 2 is an enlarged fragmentary perspective view showing the access panel construction;

FIG. 3 is a perspective view from one end of the container made from the blank of FIG. 1, filled and closed;

FIG. 4 is a fragmentary perspective view of a container made from the blank of FIG. 1, partly assembled for filling with merchandize;

FIG. 5 is a fragmentary perspective view from one end of a container of the previous Figures, showing the access panels in open position;

FIG. 6 is an enlarged vertical cross-section along the line 6—6 of FIG. 3; and FIG. 7 is an enlarged vertical cross-section along the line 7—7 of FIG. 5.

DESCRIPTION OF THE PREFERRED EMBODIMENTS

Referring more particularly to FIG. 1 of the drawings, there is shown a blank of foldable sheet material, designated generally as A, suitable for making a container according to the invention. The blank A is die cut and creased to provide it with the following parts—a floor panel 15, a roof panel 17, a side wall panel 19 and side wall-forming panels 21 and 22, rear wall-forming panels 23 and 25 at one end and front wall-forming panels 27 and 29 at the other end, and corner flaps 31, 33, 35, 37, 48 and 50.

A crease 21*a* intervenes the panel 15 and the panel 21. Creases 19*a* and 19*b* intervene the panel 19 and the panels 15 and 17 respectively. A crease 22*a* intervenes the panel 22 and the panel 17. A crease 23*a* intervenes the panels or flaps 21 and 31, 15 and 23, 19 and 48, 17 and 25, and 22 and 33 respectively. A crease 27*a* intervenes the panels or flaps 21 and 35, 15 and 27, 19 and 50, 17 and 29, and 22 and 37 respectively.

In accordance with the invention, the panel 27 is provided with a die cut 39 and a crease 38, providing a flap 41 hingeable to the panel about the crease 38.

The panel 29 is provided with a crease 43, and a die cut 44 to provide a flap 45 hingeable to the panel 29 about the crease 43.

Preferably uncut ligaments 41*a* are left between the flap 41 and the panel 27. Likewise, there is preferably left uncut a ligament 45*a* between the flap 45 and the panel 29.

A circular opening 45*b* is provided in the flap 45 and a slot 53 in the panel 27.

A part of the flap 35 is cut away to provide an opening 47, part of the flap 37 is cut away to provide an opening 49, and part of the flap 50 is cut away to provide an opening 51.

The corner flaps 31, 48, 33, 35, 50 and 37 are separated from their adjacent end panels by cuts.

In setting up the container from the flat, first the panels 21 and 19 are raised perpendicular to the panel 15 and the flaps 35 and 50 are folded behind and stapled to the panel 27, as shown in FIG. 4. The panel 29 is raised perpendicular to the panel 17 and the flap 37 is folded behind and stapled to the panel 29. Then, the panel 23 is raised perpendicular to the panel 15 and the flaps 31 and 48 are stapled to the inside of the panel 23.

Then, the flap 25 is raised perpendicular to the panel 17 and the flap 33 stapled to the inside of the panel 25. Thus, as shown in FIG. 4, there is provided a container made up of a tray part B ready to be filled with merchandize and a cover part C for closing the container once the merchandise is packed in it.

The tray is filled with any type of goods, for example, bags of shirts, dresses or otherwise.

Once the tray B is filled, the cover part C is closed so that the side-forming panel 22 overlaps the side-forming panel 21, the end-forming panel 25 overlaps the end-forming panel 23 and the end-forming panel 29 overlaps the end-forming panel 27. Staples 61 are applied through overlapping parts at appropriate places to secure the parts together in the closed container.

The specific form of container shown is a typical "clothing wrapper." As already stated, the invention is not limited to this particular type of container. For example, another type to which it may apply is a box similar to the container shown, but in which where the side 19 is connected to the top panel of the tray 17, but instead, a fourth side on the cover part takes the place of the side 19 which, in the container illustrated, joins the roof 17 of the cover part of the floor 15 of the tray part.

Containers of the types described may also be made without corner flaps. In this case they may have instead paper glued on to the walls at least at the corners to hold them together.

If the container is merely to be used as a shipping container, it is filled as described, and shipped out. If it is to be used as a stock container, before the cover part C is pushed down onto the tray part B a locking catch 60 may be inserted. Then the ligaments 41*a* and 45*a* are ruptured and the catch inserted into the opening 53 to retain the access panels closed. The container can be shipped out with or without the catch.

The flap 41 may be on a side panel, say 21, rather than on the end panel 27. In this event, the panel 22 would include a flap corresponding to the flap 45. This flap could be centered by providing a slit corresponding to 44 at each side of it.

While the clothing wrapper type has been described as having corner flaps which overlap adjoining walls, these flaps may be omitted. The same applies to the type of container in which the tray and cover parts are separate.

The containers of the invention may be made from any suitable foldable sheet material, preferably paperboard. Corrugated paperboard is preferred.

It will be seen, therefore, that the boxes described are completely usable for shipping. The catch member need only be applied to those boxes to be used as stock boxes or storage containers. In this way, the cost per box will be no higher than the ordinary box that would normally be used as a shipping container.

We claim:

1. A blank of foldable sheet material for forming a container cut and creased to provide elongated panels in series, each connected to its adjacent panel by a crease and including:

a first side-forming panel, a floor panel having a wall-forming panel at each end hinged to it by a crease, a side panel, a roof panel having a wall-forming panel hinged to it by a crease, a second side-forming panel, at one end of the blank, a door forming structure, comprising, one of said wall-forming panels of said floor panel being provided with a hinging crease parallel to and spaced from its crease connection to the floor panel and a cut extending from each end of said hinging crease towards the edge of one wall-forming panel then parallel to said hinging crease, said hinging crease and said cut defining an inside access door occupying a major area of the one wall-forming panel carried by said floor and hingeable about the hinging crease bordered by a continuous supporting frame, and a second wall-forming panel connected to the roof panel by a crease and provided with a hinging crease parallel to its crease connection with the roof panel, said hinging crease extending from one edge of said second wall-forming panel to a point spaced from the opposite edge of said second wall-forming panel, and a cut extending from the outer edge of said second wall-forming panel to said point to provide an outside access door occupying a major area of the second wall-forming panel bordered on two sides by a supporting frame, all of the wall-forming panels being of substantially the same height as the side-forming panels and of substantially the same width as the floor and roof panels, and at least one rupturable ligament formed by a skip in each cut to retain each door in its respective supporting frame.

2. A blank, as defined in claim 1, in which the outside access door is provided centrally with a hole to receive a catch member, and the inside flap is provided with an opening to receive a latch portion of the catch member.

3. A blank, as defined in claim 1, in which each cut is interrupted to provide at least one rupturable ligament connecting each access panel to its wall panel.

4. A blank of foldable sheet material for forming a container, said foldable sheet material being cut and creased to provide elongated panels in series, each connected to its adjacent panel by a crease and including:

a first side-forming panel, a floor panel, a side panel, a roof panel, and a second side-forming panel, end panels connected to each end of said floor panel and said roof panel along a crease;

and at one extremity of the blank, one end panel having a first hinging crease parallel to its crease connection to its respective panel and a cut extending from the first hinging crease defining an inside access door hingeable about the first hinging crease, and the other end panel having a second hinging crease parallel to its crease connection with its respective panel and extending from its edge closest the said one end panel to a point spaced from the opposite edge of said other end panel, and a cut extending from an outer edge of said other end panel to the second hinging crease at said point to provide a second access door, at least one panel selected from said side panel and said first side-forming panels having connected thereto at said one blank extremity by a crease a corner flap adjacent to said one end panel, and said corner flap having an opening to clear the access doors and a part for overlapping said one end panel.

5. A container of foldable sheet material, comprising, a tray part made up of a floor panel and upstanding therefrom a pair of side panels and first and second end panels each having a crease connection with said floor panel, a cover part, comprising a roof panel, including at least one side panel overlapping one side panel of said tray part and first and second end panels each having a crease connection with said roof panel and overlapping the corresponding end panels of the tray part.

and at one end of the container said first end panel of said tray part having a first hinging crease spaced from its crease connection to the floor panel and a cut extending away from each end of the first hinging crease towards a remote edge of said tray part first end panel and then parallel to the first hinging crease to provide an inside access door occupying a major area of said tray part one end panel, said inside access door being hingeable about the first hinging crease and being bordered by a continuous frame, said first end panel of said cover part having a second hinging crease spaced from and parallel to its crease connection with the roof panel and extending from a side edge to a point spaced from an opposite side edge and a cut extending from said point to its edge remote from the roof panel to provide an outside access door occupying a major area of said cover part first end panel, said door being bordered on two sides by a frame, said end panels extending substantially all the way from the floor panel to the roof panel and from one side panel to the other, said end panels further being of substantially the same height as the side panels and of substantially the same width as the floor panel and the roof panel, and at least one rupturable ligament formed by a skip in each cut to at least initially retain each door in its respective frame.

6. A container, as defined in claim 5, in which the roof panel of the cover part is hingedly connected to one side panel of the tray part.

7. A container, as defined in claim 5, in which the outside access door is provided with a catch member and the continuous frame of said first end panel of said tray part with an opening for engagement by the catch member.

8. A container as defined in claim 7 wherein said opening is in part bounded by said first hinging crease.

9. A container, as defined in claim 5, in which each cut is interrupted to provide at least one rupturable ligament connecting each access door to its respective end panel.

10. A stackable load bearing container comprising a tray part and a displaceable cover part seated on said tray part to provide access to said tray part from the top thereof, said tray part including a floor panel, two upstanding side panels and two upstanding end panels, said cover part including a roof panel seated on said side and end panels, an access door formed in one of said tray part end panels and connected thereto along a hinge crease disposed in adjacent spaced relation to and parallel to the connection between said one end panel and said floor panel, said one end panel defining a continuous frame surrounding said access door and rigidly interconnecting said side panels, and said cover part having an end panel depending from said roof panel and overlapping said tray part one end panel, said cover part end panel being free of said tray part one end panel and displaceable with said roof panel to provide access to said tray part from the top thereof, and said cover part one end panel having an access door aligned with said tray part access door to provide access to said tray part from one end.

* * * * *